US006302158B1

(12) United States Patent
Sheldon

(10) Patent No.: US 6,302,158 B1
(45) Date of Patent: Oct. 16, 2001

(54) SAND LEVEL SENSING AND DISTRIBUTION APPARATUS

(75) Inventor: David Samuel Sheldon, Homewood, AL (US)

(73) Assignee: Vulcan Engineering Company, Inc., Helena, AL (US)

( * ) Notice: Subject to any disclaimer, the term of this patent is extended or adjusted under 35 U.S.C. 154(b) by 0 days.

(21) Appl. No.: 09/593,331

(22) Filed: Jun. 14, 2000

(51) Int. Cl.[7] ..... B65B 1/04

(52) U.S. Cl. ..... 141/1; 141/95; 141/198; 222/64

(58) Field of Search ..... 141/1, 95, 198; 222/64, 185.1

(56) References Cited

U.S. PATENT DOCUMENTS 4,593,739 6/1986 VanRens et al. .
4,600,046 7/1986 Bailey et al. .
4,629,392 * 12/1986 Campbell et al. .
4,784,206 11/1988 Sauerman et al. .
5,067,549 11/1991 Musschoot .
5,664,699 * 9/1997 Kennedy et al. .
6,170,718 * 1/2001 Ziegler et al. .

* cited by examiner

*Primary Examiner*—Steven O. Douglas
(74) *Attorney, Agent, or Firm*—Christopher A. Holland; Robert J. Veal; Burr & Forman LLP

(57) ABSTRACT

A sand level sensing and distribution apparatus for monitoring and controlling the quantity of sand distributed from a batch hopper into a mold flask includes a sensor assembly connected to a level actuating assembly via a carriage assembly. A window is mounted within one wall of the batch hopper such that the sensor assembly may be used to monitor the level of sand within the batch hopper. The level actuating assembly is proximate the batch hopper, and the sensor assembly is therefore proximately positioned by said window. A control unit is included to receive the monitored signal from the sensor assembly, and, using such information, to control the operation of the level actuating assembly in positioning the sensor assembly to distribute the desired amount of sand into the mold flask. Moreover, a sand gate assembly is mounted subjacent the batch hopper, and the control unit also operates to control when the sand gate assembly is in an open position to distribute sand from the batch hopper into the mold flask.

9 Claims, 9 Drawing Sheets

SAND LEVEL SENSING AND DISTRIBUTION APPARATUS

FIELD OF THE INVENTION

The present invention relates to an apparatus for use in a foundry operation. More particularly, the present invention relates to an apparatus for controlling the distribution of sand into a mold flask in a casting process, such as a lost foam casting process.

BACKGROUND OF THE INVENTION

In a typical lost foam casting process, a foam mold pattern is placed within a mold flask, wherein the foam pattern includes a foam riser that extends from the foam pattern toward the top of the flask. Sand from a batch hopper located above the flask is poured into the flask around the foam pattern. As the sand fills the flask, the sand compacts about the foam pattern through the use of vibration. After the flask has been adequately filled with sand, which preferably corresponds to a level equal to the top of the riser, molten metal is poured onto the riser to engage the foam pattern, and the molten metal vaporizes the foam riser and pattern. Thus, the molten metal replaces the foam pattern. The metal is cooled until the casting is solidified, at which time the casting and sand are removed from the flask.

The distribution of sand into the flask in many prior art embodiments is controlled through monitoring the period of time during which the sand gate is in an open position. Using such a method, the user estimates the length of time that is required to distribute the desired amount of sand around a particular foam pattern according to the complexity of the design of the pattern, and the user opens the sand gate for this proper period of time. As a result, the accurate and desired distribution of sand using this method may not occur due to the varying conditions of the types of sand used and the flowability related thereto. For example, if the sand does not flow well from the batch hopper, then the sand received in the flask will be too low to fill the cavities of the foam pattern. This problem is illustrated in FIG. 1A wherein sand 2 does not engage the cavity 6 within the foam pattern 4. However, if the sand overflows into the flask, there is too much overburden at the entrance of the cavity 6 and the sand will not be fluidized at the entrance of the cavity 6 of the pattern. As a result, the sand will not be able to fully fill the cavities of the pattern. This problem is illustrated in FIG. 1B wherein sand 2 substantially overburdens the foam pattern 4 and does not fully fill the cavity 6. Additionally, if the user desired to deposit multiple different layers of sand from the batch hopper using the timing method, each independent and different layer of sand would be subject to inaccuracies caused by the variations in the flow rates of sand, which will also provide a cumulative effect of providing multiple inaccurate layers within the flask. However, looking at FIG. 1C, when the proper depth of sand 2 is distributed into the flask having the desired flow rate, there will be only a slight overburden of the sand 2 on the pattern 4, which will promote the rapid and complete filling of the cavity of the pattern 4.

Accordingly, what is needed is a sand level sensing and distribution apparatus to provide an accurate control of the depth and flow rate of the layers of sand that are deposited into the flask such that the sand in the flask will flow to a proper height around the mold positioned in the flask to substantially surround and engage a foam pattern.

SUMMARY OF THE INVENTION

It is an object of the present invention to provide an apparatus operating to control the depth of the distribution of sand from a batch hopper into a mold flask in a casting process to surround a mold and substantially fill the cavities of the mold with sand.

It is another object of the present invention to provide a sand distribution apparatus to continuously monitor and control the amounts of sand distributed from the batch hopper into the mold flask.

It is a further object of the present invention to provide a sand distribution apparatus having an improved method of controlling the amount of sand distributed from the batch hopper into the mold flask.

It is a further object of the present invention to provide a sand distribution apparatus to disperse varying amounts of sand from a batch hopper to a mold flask according to predetermined sand level requirements according to the mold being cast.

These and other objects of the present invention are accomplished through the use of a sand level sensing and distribution apparatus for promoting desired sand distribution into a mold flask in a casting process, such as a lost foam casting process. The sand level sensing and distribution apparatus comprises a batch hopper substantially filled with sand to be distributed from the batch hopper into a mold flask. The batch hopper includes a window that allows a sensor assembly to monitor the sand contained within the batch hopper. The sensor assembly is proximately positioned close to the side of the batch hopper, with the sensor assembly including a sensor member positioned adjacent the window to monitor the distribution of sand into the flask below. The sensor assembly is attached to a level actuating assembly that is operable to move the sensor assembly vertically such that the sensor member may traverse the length of the window. The level actuating assembly includes a motor that is connected to a central processing unit such that the central processing unit controls the operation of the motor in vertically positioning the sensor assembly. The sensor assembly is additionally connected to the central processing unit, and the central processing unit uses the sensor assembly to receive current information to control the operation of the motor of the level actuating assembly.

In operation, the sensor assembly is first moved to a "start" or "home" position, and then locates the top level of the sand within the batch hopper via the sensor assembly. The sensor assembly provides one signal while measuring sand, and once the sensor reaches the top level of sand, the state of the sensor changes, indicating that the sensor assembly has come to the top level of sand within the batch hopper. The central processing unit, having been programmed with a "recipe" of the desired parameters for distributing the sand into the flask, then controls the downward movement of the sensor assembly. From the top level of the sand within the batch hopper, the sensor assembly is moved downward a distance as desired by the user and programmed into the central processing unit. Once the sensor assembly has reached the desired level, the central processing unit opens the sand gate subjacent the batch hopper such that sand is distributed from the batch hopper into the flask. The sensor assembly provides a continuous monitoring of the distribution of sand into the flask, and once the top level of sand reaches level of the sensor assembly, a signal is provided to the central processing unit to close the sand gate and stop the flow of sand. The sensor assembly, controlled by the central processing unit, is then moved downward again, according to the recipe, to the next desired level. The central processing unit again opens the sand gate, and sand flows until the top level of the sand reaches the sensor assembly. These steps are thereby repeated, as programmed in the recipe, until the sand completely and substantially evenly surrounds the mold in the flask as desired by the user. The flask is then moved to a separate station to allow molten liquid to be poured onto the mold surrounded by sand.

Once the flask is moved to a separate station, the batch hopper is again partially filled with sand, and the sensor assembly is reset to the top sand level within the batch hopper. The sensor assembly is then operable to control the distribution of sand as desired by the user, and repeats the sand distribution steps described above.

These and other objects and advantages of the invention will become apparent from the following detailed description of the preferred embodiment of the invention.

BRIEF DESCRIPTION OF THE DRAWINGS

A sand level sensing and distribution apparatus embodying features of the invention is described in the accompanying drawings which form a portion of this disclosure and wherein.

DETAILED DESCRIPTION OF THE PREFERRED EMBODIMENT

Figures 1A, 1B, 1C:
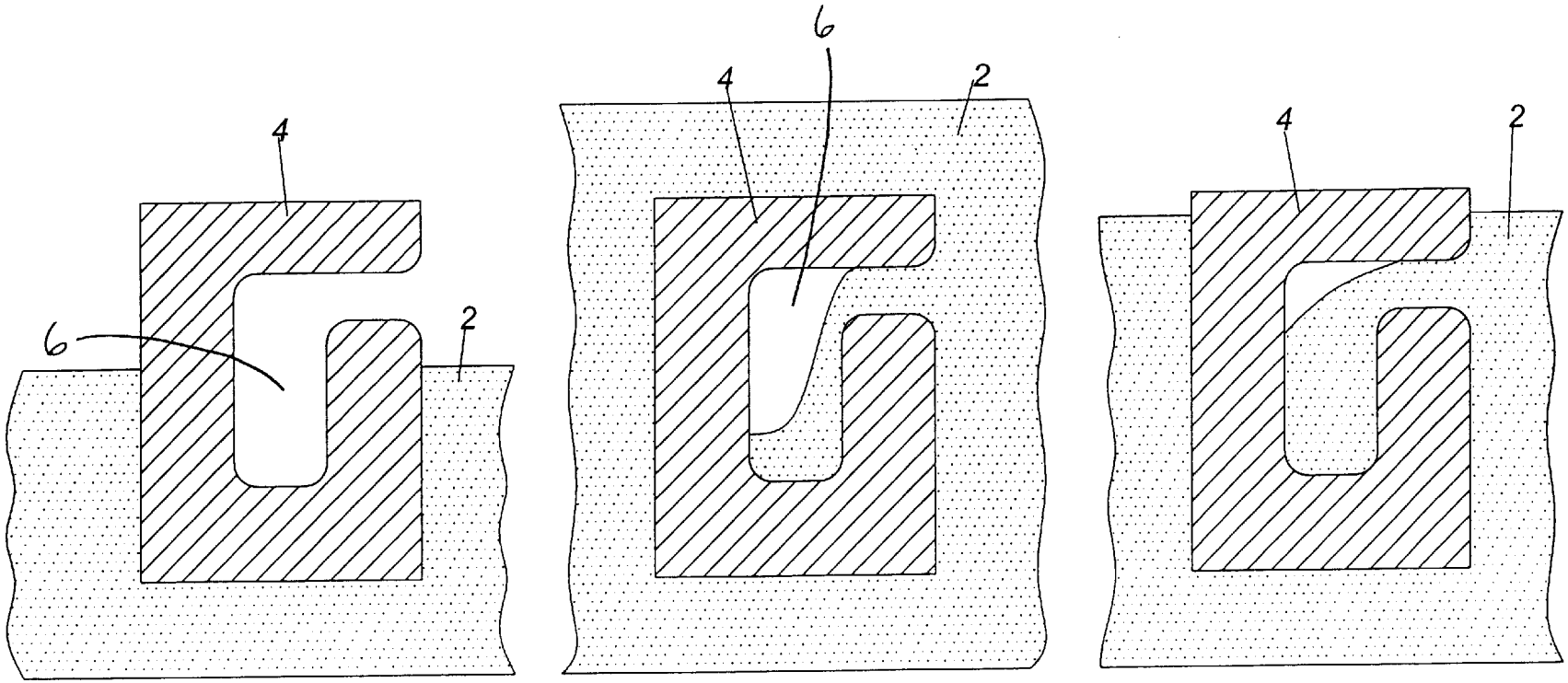
FIG. 1A is a sectional view of a foam pattern having an undesirable under-distribution of sand.
FIG. 1B is a sectional view of a foam pattern having an undesirable over-distribution of sand.
FIG. 1C is a sectional view of a foam pattern having a desirable distribution of sand.
Figure 2:
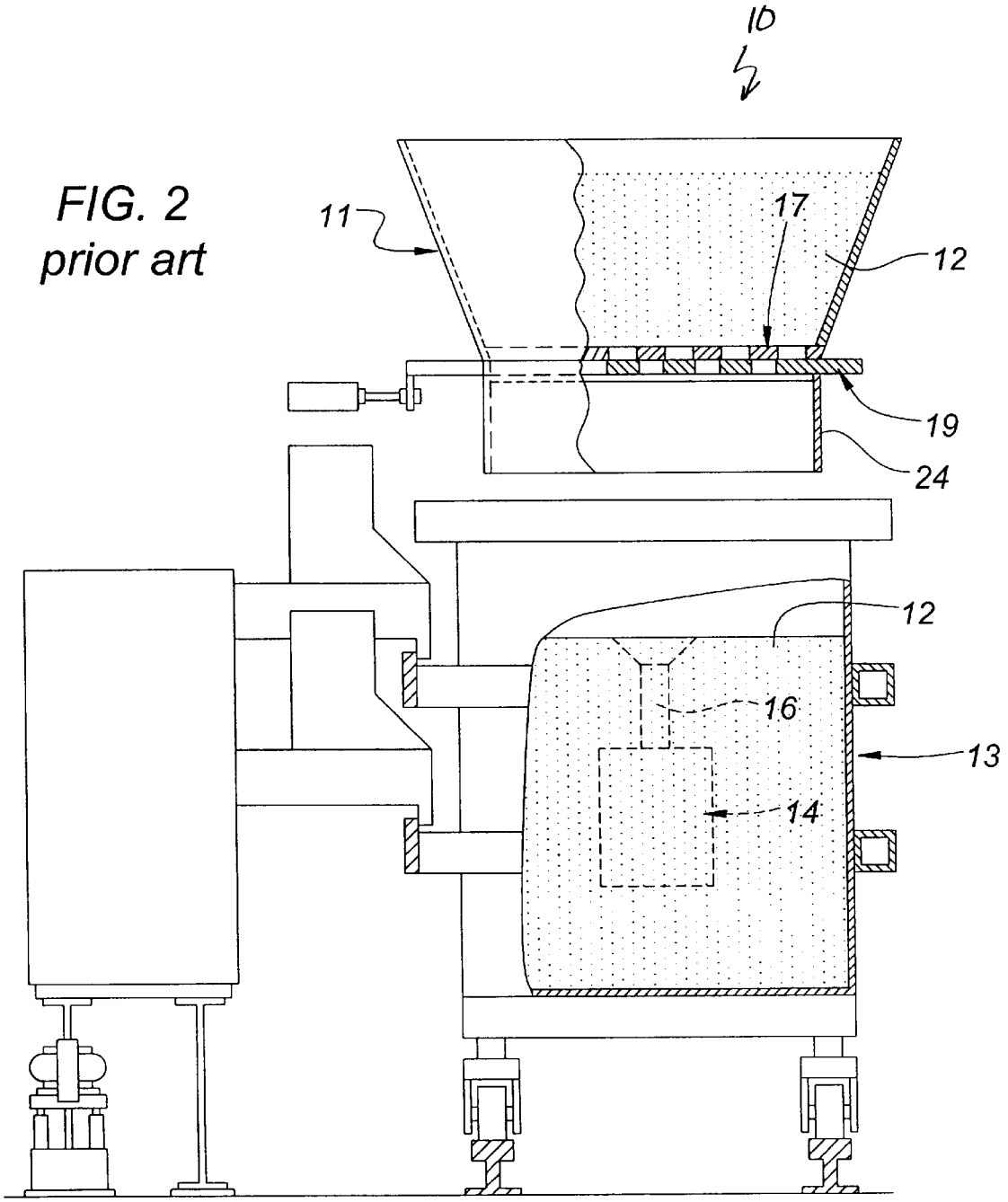
FIG. 2 prior art
FIG. 2 is a side elevational view, partially broken away and in section, of a conventional sand filling station in a prior art foundry operation.

A more complete understanding of the invention may be obtained by reference to the accompanying drawings wherein the sand filling station 10 of a prior art foundry operation is illustrated in FIG. 2. The sand filling station 10 of the prior art includes a batch hopper 11 having a supply of sand 12 that is suspended over a mold flask 13 having a foam mold pattern 14 therein, and a guide jacket 24 may be included to direct the sand into the mold flask 13. The foam pattern 14 includes a foam riser 16 extending from the foam pattern 14 towards the top of the flask 13. A sand gate is mounted subjacent the batch hopper 11, with the sand gate conventionally including a first distribution plate 17 and a second distribution plate 19. The first distribution plate 17 and the second distribution plate 19 have a plurality of apertures, with the second distribution plate 19 slidably mounted subjacent the first distribution plate 17 such that the second distribution plate 19 is movable between a closed position, wherein the apertures through the first and second distribution plates 17, 19 do not overlap, and an open position, wherein the apertures through the first and second distribution plates 17, 19 overlap such that multiple streams of sand can flow through the first and second distribution plates 17, 19 into the flask 13.

This prior art sand filling station 10 is operable to control the distribution of sand from the batch hopper 11 into the flask 13 by providing a pre-determined timing of when the distribution plates 17, 19 will be in the open position. Therefore, the amount of sand deposited into the flask 13 is determined according to the time that the distribution plates 17, 19 are in the open position. A problem using such a method for controlling the flow of sand into the flask 13 is that the method generates inaccurate results since the flowability of sand will vary according to the type of sand used and the condition of that sand. For example, previously used sand will have a tendency to "gum up," and therefore not flow at the same rate as previously unused sand. As a result, using the method of timing when the distribution plates 17, 19 will be in the open or closed position will not provide an accurate means for controlling the flow of sand into a flask 13.

Figure 3:
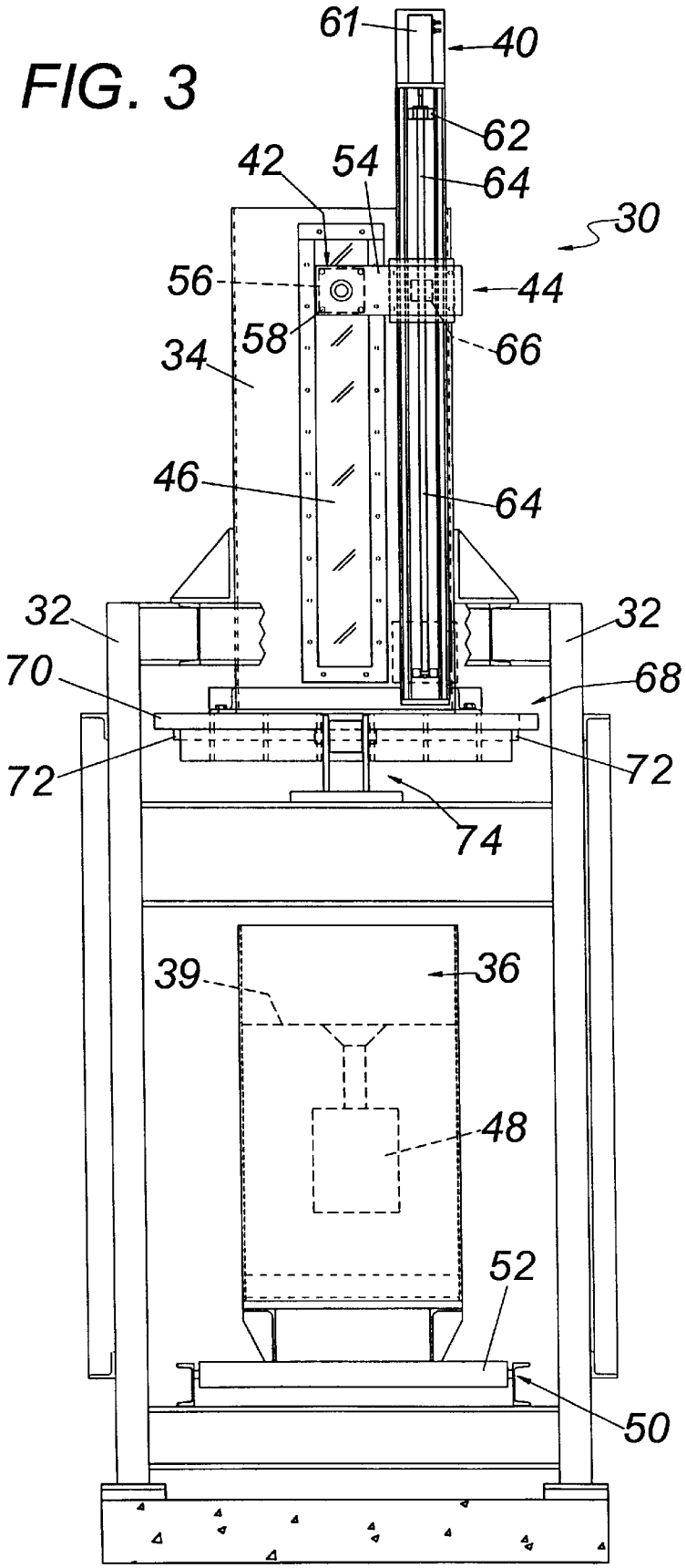
FIG. 3 is a rear elevational view of the sand level sensing and distribution apparatus of the present invention.
Figure 6:
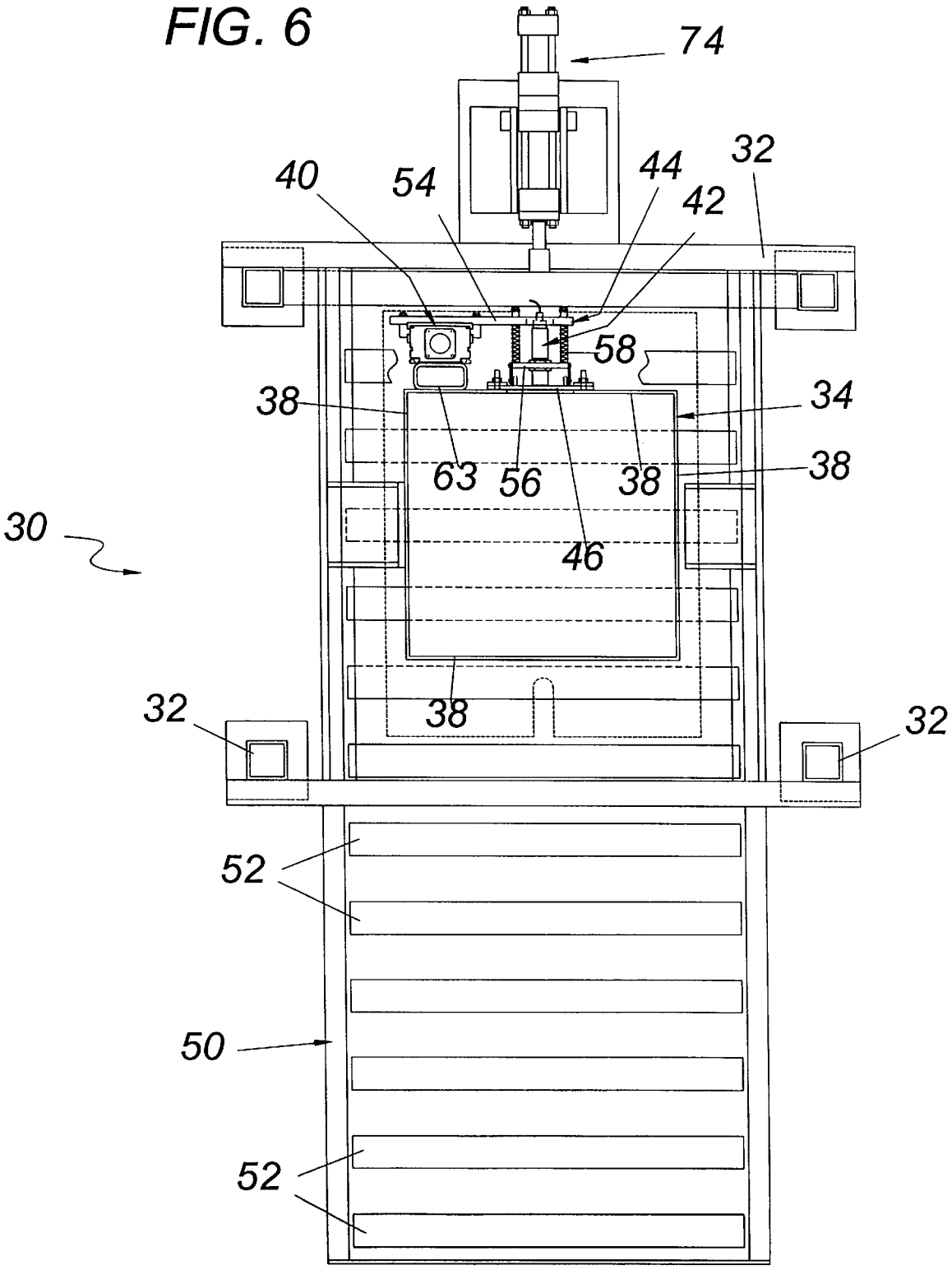
FIG. 6 is a top plan view of the sand level sensing and distribution apparatus of the present invention.

Looking to FIG. 3, the present sand level sensing and distribution apparatus 30 is illustrated. The sand level sensing and distribution apparatus 30 is useful to overcome the problems and shortcomings of sand distribution in the prior art described above. The sand level sensing and distribution apparatus 30 includes a frame 32, with a batch hopper 34 attached to the frame 32 in a position above a mold flask 36. The batch hopper 34 of the present invention preferably has four side walls 38 (see the top plan view of FIG. 6) to hold sand 39 similar to a conventional batch hopper, and a level actuating assembly 40 is attached along one side wall 38 of the batch hopper 34, with a sensor assembly 42 further attached to the level actuating assembly 40 via a carriage assembly 44.

Figure 4:
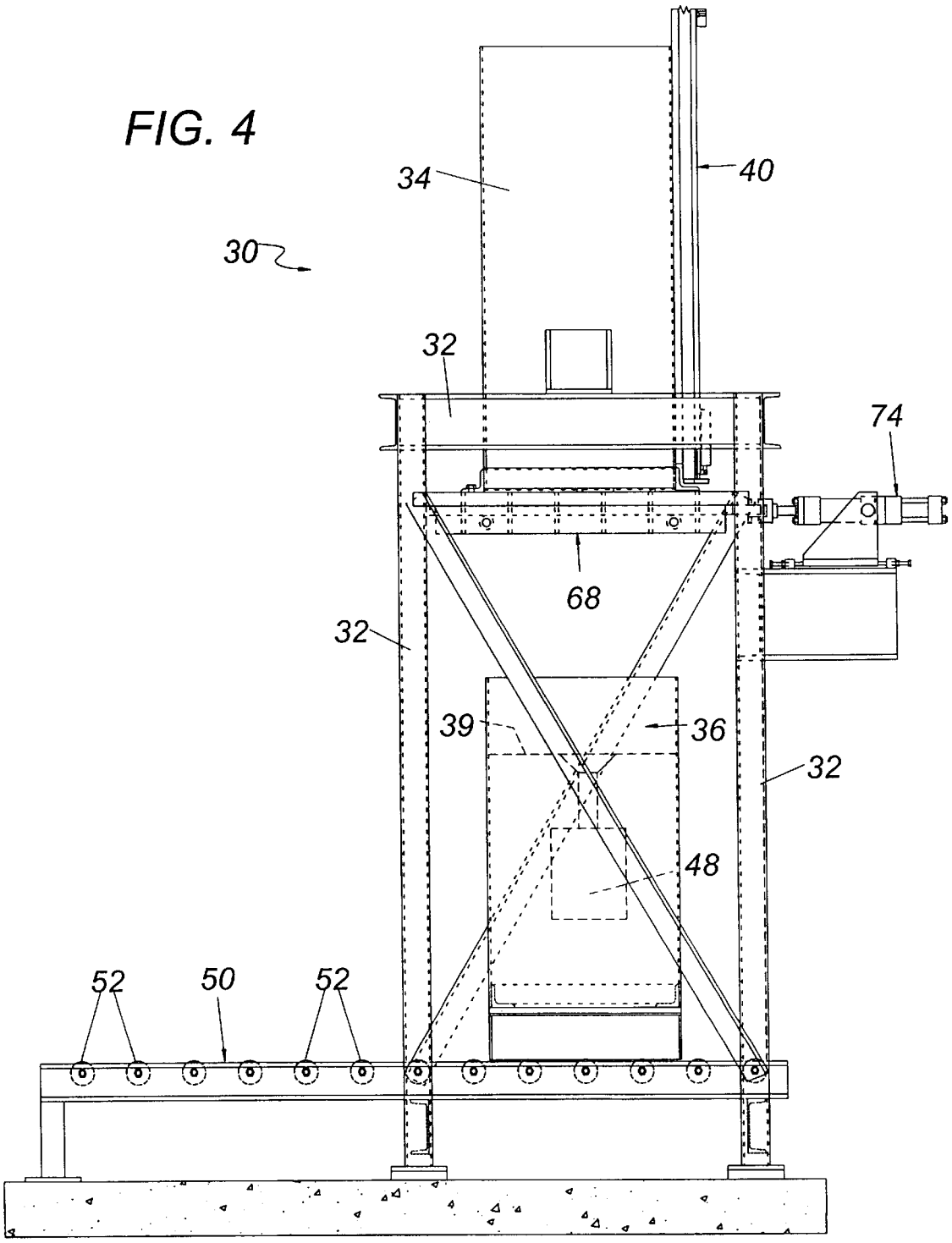
FIG. 4 is a side elevational view of the sand level sensing and distribution apparatus of the present invention.
Figure 5:
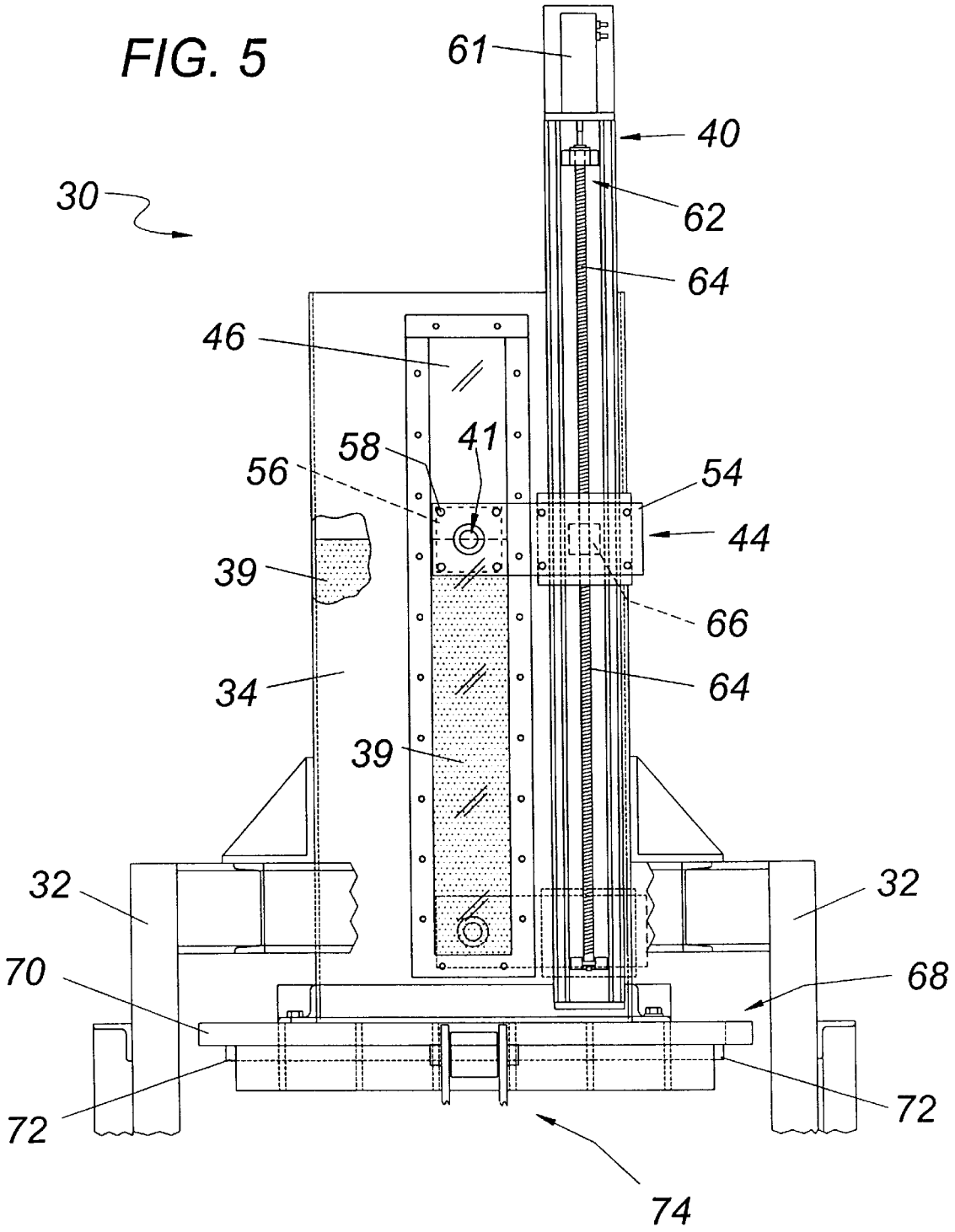
FIG. 5 is a partial rear elevational view of the sand level sensing and distribution apparatus as illustrated in FIG. 3, this view illustrating the batch hopper, sensor assembly, carriage assembly, and level actuating assembly of the present invention.

Looking at FIGS. 3 and 5, a window 46 is mounted in at least one of the side walls 38 of the batch hopper 34. The window 46 is preferably either transparent or translucent, and it is further preferably made of plastic (for example, a polycarbonate plastic) to be able to handle the pressure from the sand 39 within the batch hopper 34. The window 46 may also be made of other transparent or translucent materials, such as glass, as desired by the user. The batch hopper 34 is located above the flask 36 containing a mold 48 such that the mold 48 will be surrounded by sand 39 within the flask 36 as the sand 39 is poured from the batch hopper 34. Looking at FIGS. 4 and 6, one method for positioning the flask 36 under the batch hopper 34 is through the use of a conveyor track 50 having a series of rollers 52. Using the conveyor track 50, the flask 36 may easily be moved under the batch hopper 34 to receive the sand 39, and then easily moved away once the flask 36 has been substantially filled with sand 39.

Looking at FIGS. 3, 4, and 5, the sensor assembly 42 and the carriage assembly 44 of the sand level sensing and distribution apparatus 30 are illustrated connected to the level actuating assembly 40. The sensor assembly 42 is connected to the carriage assembly 44, and the carriage assembly 44 is attached to the level actuating assembly 40 to provide vertical movement along one side wall 38 of the batch hopper 34. Looking at FIGS. 7, 8, and 9, the sensor assembly 42 includes a sand level sensor member 41 and a sensor mount 43 rigidly connecting the sensor member 41 to the carriage assembly 44. The sensor member 41 used in the preferred embodiment of present invention is a capacitive proximity sensor, as is known in the art, although there are various other sensors that may be used to detect sand 39 within the batch hopper 34. The sensor assembly 42 is therefore operable to determine, by sending and receiving a signal through the window 46, whether the sand 39 is present or not present behind the window 46 at the vertical level of the sensor member 41.

Figure 8:
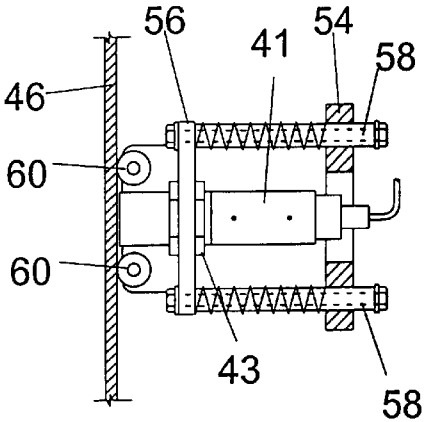
FIG. 8 is a side elevational view of the carriage assembly and the sensor assembly of the present invention, the view taken along the lines 8—8 of FIG. 7.
Figure 7:
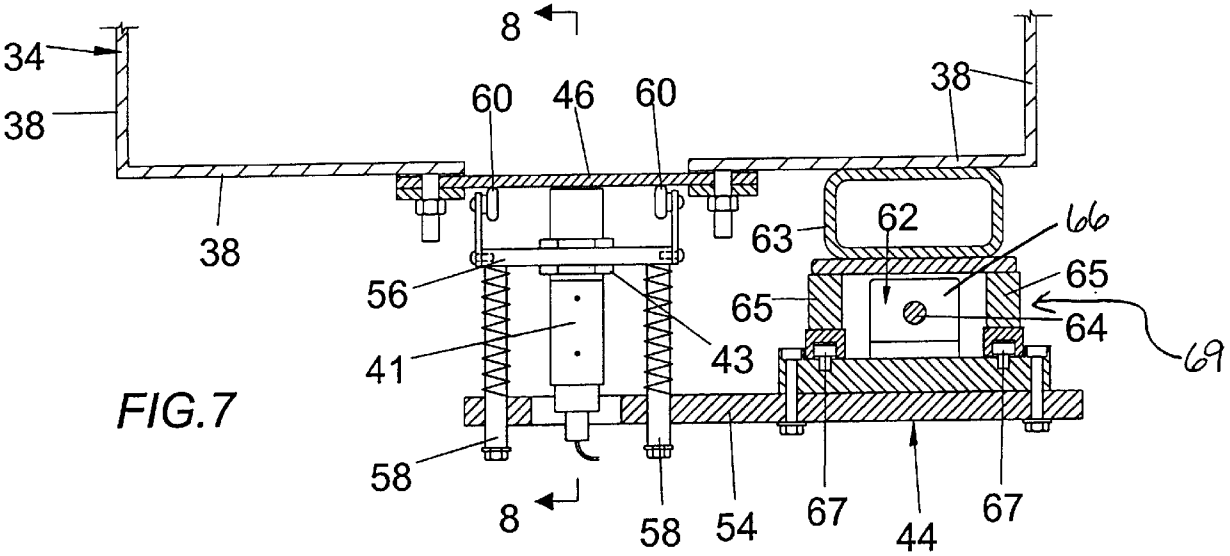
FIG. 7 is a partial top plan sectional view of the batch hopper, the carriage assembly, and the sensor assembly of the present invention.
Figure 9:
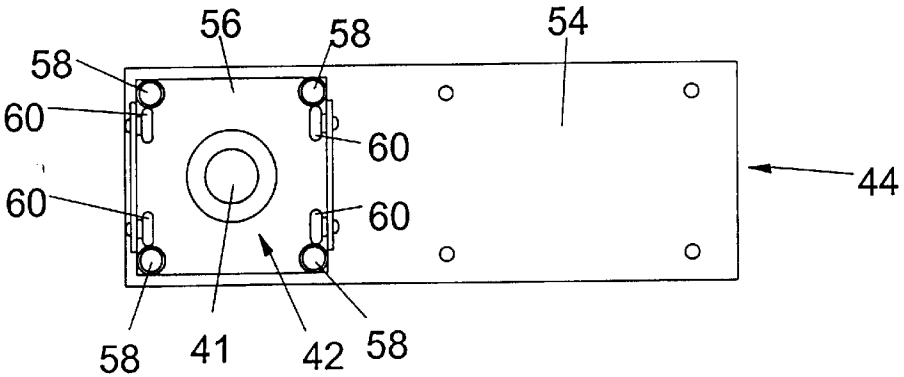
FIG. 9 is a front elevational view of the of the carriage assembly and the sensor assembly of the present invention.

Looking further at FIGS. 7, 8, and 9, the carriage assembly 44 includes a main plate 54 and a floater plate 56. In the preferred embodiment, the floater plate 56 is connected to the main plate 54 via a plurality of arm members 58 that are spring loaded resilient members, such as shock absorbers. However, resilient members are not required in all embodiments; for example, a precise assembly may not require such resilient members. Preferably at least two arm members 58 are used to provide a balanced connection between the main plate 54 and the floater plate 56. The main plate 54 is attached to the level actuating assembly 40, while a series of carriage wheels 60 (or similar rotatable members) are attached to the floater plate 56 such that the floater plate 56 is able to resiliently engage and traverse one side wall 38 of the batch hopper 34. The arrangement of the arm members 58 with the floater plate 56 and the carriage wheels 60 allows the sensor assembly 42, engaging the floater plate 56, to be in close proximity to the window 46 (see FIG. 8). The arm members 58 thereby work to ensure that there is a small gap (approximately one millimeter) between the end of the sensor member 41 and the window 46, the arm members 58 ensuring that the gap is consistently maintained throughout the range of travel along the window 46. The close proximity between the sensor member 41 and the window 46 is beneficial in that the closer the sensor member 41 is to the window 46, the more accurate the measurements that will be obtained by the sensor assembly 42.

As stated above, the carriage assembly 44 is connected to the level actuating assembly 40, and the level actuating assembly 40 is operable to control the vertical movement of the carriage assembly 44 and attached sensor assembly 42. Looking at FIGS. 5 and 6, the level actuating assembly 40 of the present invention preferably includes a motor 61 connected to a ball screw assembly 62. The ball screw assembly 62 includes a threaded rod 64, which is connected to the motor 61, and a threaded nut 66 engaging the threaded rod 64. The motor 61 therefore rotates the threaded rod 64 to control the lateral movement of the threaded nut 66 along the length of the threaded rod 64. Looking at FIG. 7, the threaded nut 66 is additionally connected to the main plate 54 of the carriage assembly 44 so that lateral movement of the threaded nut 66 generates lateral movement of the carriage assembly 44 and sensor assembly 42. Additionally, a support beam 63 is attached to the batch hopper 34, with a pair of guide assemblies 69 attached to the support beam 63. The guide assemblies 69 operate to provide stable lateral movement of the carriage assembly 44, and one preferred embodiment of the guide assemblies 69 includes a pair of slider blocks 65 that surround a pair of slider rails 67 attached mounted to the main plate 54, with a series of recirculating ball bearings (not illustrated) positioned between the slider blocks 65 and slider rails 67. It should further be noted that while the preferred embodiment of the level actuating assembly 40 includes the ball screw assembly 62, any number of actuator designs may be implemented in the current invention to create the desired lateral movement of the carriage assembly 44 and the sensor assembly 42.

The sand level sensing and distribution apparatus 30 additionally includes a sand gate assembly 68 mounted subjacent the batch hopper 34 to control the distribution of sand 39 from the batch hopper 34. Several different embodiments of sand gate assemblies may be used in the present invention; however, the preferred embodiment of the sand gate assembly 68 of the present invention includes a proximal plate 70, a distal plate 72, and a sand gate actuating means 74. The proximal plate 70 is positioned subjacent the batch hopper 34, and the distal plate 72 proximately engages the proximal plate 70. Preferably, the proximal plate 70 is stationary, while the distal plate 72 is connected to the sand gate actuating means 74 that, when operating, slides the distal plate 72 below the proximal plate 70 between an opened and closed position. Therefore, movement of the distal plate 72 will control when the sand gate 68 is opened or closed to allow sand 39 to flow through. In the preferred embodiment, the sand gate actuating means 74 includes a hydraulic cylinder, although there are various embodiments that may be implemented to control the operation of the sand gate 68.

Figure 10:
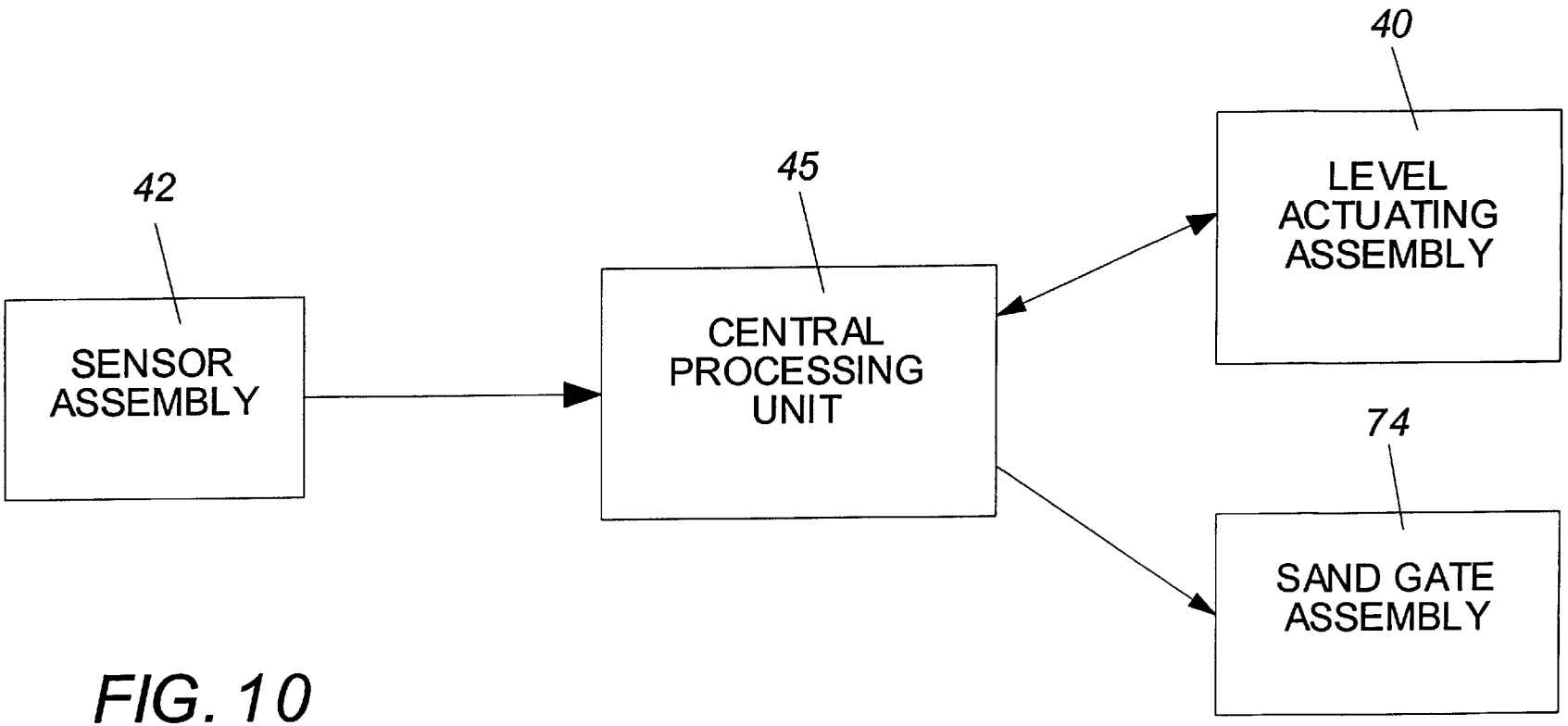
FIG. 10 is a functional block diagram illustrating the use of the central processor to receive measurements from the sensor assembly to control the level actuating assembly and the sand gate actuating means.

Referring to the block diagram of FIG. 10, the sensor assembly 42 is additionally connected to a control unit, which is a central processing unit 45 in the preferred embodiment. The connection between the sensor assembly 42 and the central processing unit 45 is such that the sensor assembly 42 will relay signals to the central processing unit 45 to determine when the top level of sand 39 is the same level as that of the sensor assembly 42. In addition to the connection to the sensor assembly 42, the central processing unit 45 is also connected to the level actuating assembly 40 and the sand gate actuating means 74 to control their operation. The central processing unit 45 is linked to the motor 61 of the level actuating assembly 40 to control when the level actuating assembly 40 moves the threaded nut 66 and the distance that the threaded nut 66 is moved, and additionally the central processing unit 45 will receive motion variable feedback from the level actuating assembly 40 to determine the position, velocity and acceleration of the level actuating assembly 40. The central processing unit 45 is also linked to the sand gate actuating means 74 to control the sand gate 68 to move between an open position and a closed position.

Figure 11:
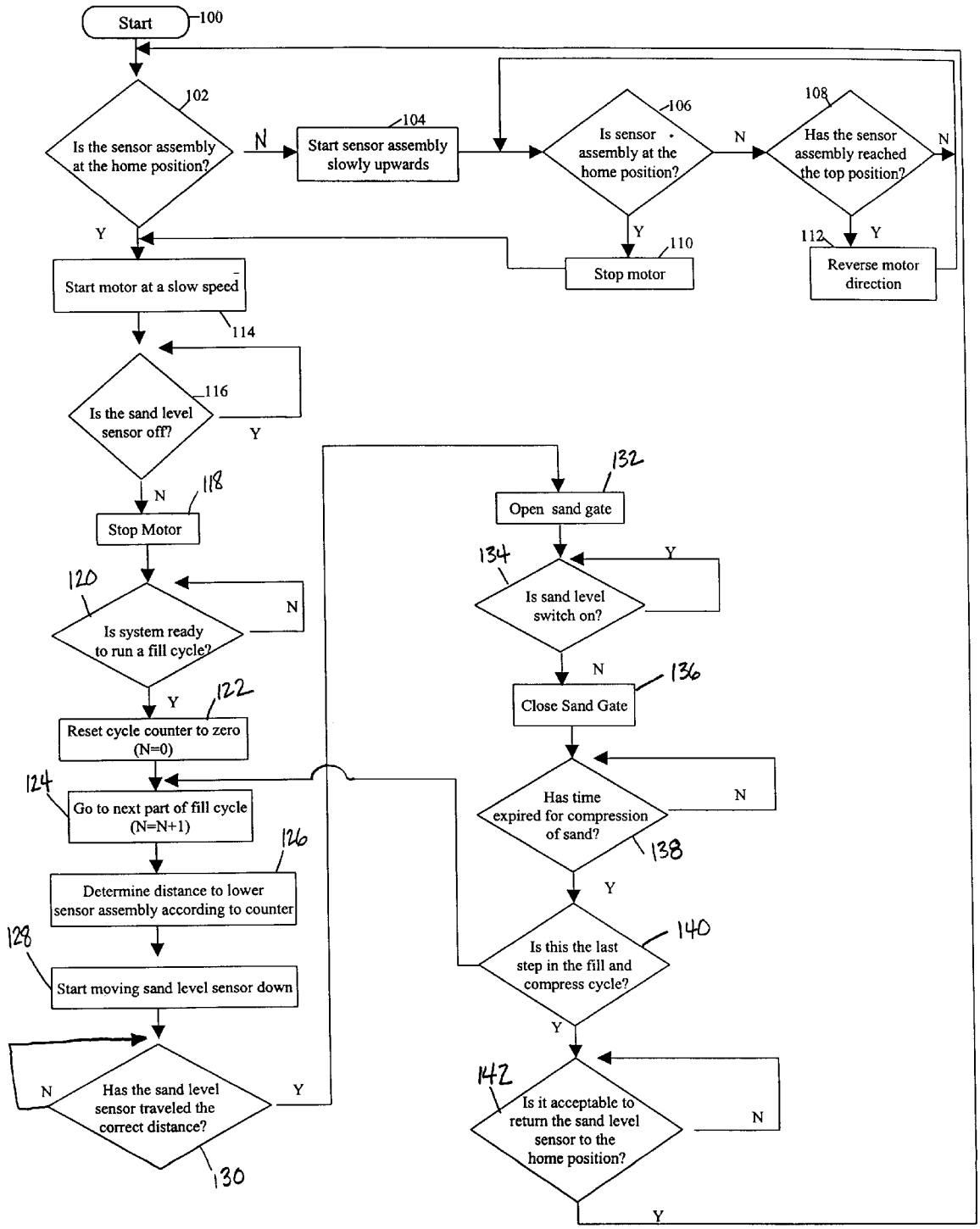
FIG. 11 is a flow chart illustrating the process implemented by the present invention in filling the mold flask with sand and compacting the sand around the mold contained in the mold flask.

In operation, the sand level sensing and distribution apparatus 30 operates to control the distribution of sand 39 from the batch hopper 34 to the flask 36 by monitoring the level of the sand 39 within the batch hopper 34. More specifically, sand 39 is first poured into the batch hopper 34. After the batch hopper 34 is substantially filled, the sand level sensing and distribution apparatus 30 follows the steps illustrated in flow chart of FIG. 11 to distribute sand 39 from the batch hopper 34 to the flask 36, and then allow the sand 39 to be compacted about the mold 48. The method of the present invention begins with the start step 100. Upon commencing, the next step is the home position step 102, wherein the central processing unit 45 determines if the threaded nut 66 (and hence the sensor assembly 42) is located at a predetermined home position, which is preferably to be found toward the uppermost portion of the batch hopper 34. If the sensor assembly 42 is not at the home position, the sensor assembly 42 is slowly moved upward toward the home position, as indicated by step 104. As the sensor assembly 42 is moved upward, the central processing unit 45 will continue to check whether the sensor assembly 42 is at the home position (step 106). If the sensor assembly 42 reaches the home position, then the motor 61 is stopped (step 110) so that the sensor assembly 42 no longer travels upward. If the sensor assembly 42 is not at the home position, the central processing unit 45 determines whether the sensor assembly 42 has reached the highest possible position (step 108), and if so, the direction of the motor 61 is reversed (step 112) to lower the sensor assembly 42 to the home position. Otherwise, the sensor assembly 42 continues to slowly move upwardly toward the home position.

Once the sensor assembly 42 is at the home position, the central processing unit 45 directs the motor 61 to begin operation at a slow speed (step 114) for the sensor assembly 42 to move downward to locate the top level of the sand 39 within the batch hopper 34. The central processing unit 45 will continue to check whether the sensor member 41 is transmitting a signal or not transmitting a signal to determine whether the sensor member 41 is at the top level of the sand 39 (step 116). If the sensor member 41 is transmitting a signal, then that means that the sensor member 41 detects sand 39 within the batch hopper 34, which means that the sensor member 41 is at the same level as the top level of sand within the batch hopper 34. At such a time, the central processing unit 45 will stop the operation of the motor 61 (step 118).

Looking now to step 120, the central processing unit 45 will determine whether the system is ready to run a sand fill cycle in which the flask 36 is filled with sand 39. If so, the central processing unit 45 will create a cycle counter having a variable N that is initially set to zero (step 122). The variable N of cycle counter is then incremented (step 124), and the central processing unit 45 will determine the distance to drop the sensor member 41 according to the value of the variable N (step 126). The central processing unit 45 then activates the motor 61 to lower the threaded nut 66 and hence the sensor assembly 42 (step 128). As shown in step 130, the central processing unit 45 receives feedback from the level actuating assembly 40 to determine if the sensor assembly 42 has traveled the correct distance downward below the top level of the sand 39. If so, the central processing unit 45 directs the sand gate actuating means 74 to move the distal plate 72 such that the sand gate assembly 68 is in an open position (step 132). The sand gate assembly 68 is kept in the open position, and the central processor unit 45 continues to receive feedback from the sensor member 41 to determine whether the sand level switch on the sensor member 41 is on (step 134). The sand gate assembly 68 will remain open as long as the sensor member 41 is on. However, once the sensor member 41 is not on and is not providing a signal, then the central processing unit 45 will close the sand gate assembly 68 (step 136) to stop the flow of sand 39. Once the sand gate assembly 68 has been closed, the central processing unit 45 provides a predetermined amount of time to allow the sand 39 to settle and compact within the batch hopper 34 (step 138). Once the time has expired for the step of the cycle, the central processing unit 45 determines whether this is the last step in the fill and compact cycle (step 140). If it is not, then the cycle is repeated beginning at step 124, with the variable N of the cycle counter being incremented. These steps are thereby repeated until the sand 39 completely surrounds the mold 48 in the flask 36 as desired by the user. If the mold 48 is surrounded by sand 39, then the central processing unit 45 will wait for an instruction from the user determining whether the sensor assembly 42 should be reset in the home position (step 142). Once the user provides the instructions to start again, the process will resume at step 100 to fill another flask 36. Once filled, the flask 36 is moved from below the batch hopper 34 to a separate station to allow molten liquid to be poured onto the mold 48 surrounded by sand 39.

In controlling the movement of the carriage assembly 44 by the level actuating assembly 40, the central processing unit 45 is programmed with a "recipe" of the desired parameters for distributing the sand 39 into the flask 36. This recipe is determined according to the desired flow rate of the sand 39 into the flask 36, as well as what depths the user would like to deposit the sand 39 to in each step. That is, the user determines what quantity of sand 39 is desired to be distributed from the batch hopper 34 into the flask 36 according to the mold 48 positioned in the flask 36, and the central processing unit 45 is so programmed. As a result, the central processing unit 45 may divide the level of sand into multiple steps or zones, allowing more sand 39 to flow in some steps, while allowing less sand 39 to flow during other steps according to the shape and strength of the mold 48. Moreover, the central processing unit 45 will also control the time and intensity of the vibrations applied to the flask 36 in the compaction of the sand 39 about the mold 48, which is an integral element of the compaction recipe. As an example, for a batch hopper 34 having a height of one meter, the recipe could be one that allows distribution of the first 30 centimeters of sand 39, then the next 45 centimeters of sand 39, and then the next 25 centimeters of sand 39. There can be as many separate steps or zones in the recipe as the user desires for the particular mold 48.

It should additionally be noted that while the above description is particularly directed to a lost foam casting process, the present invention has application in any foundry operation in which sand is distributed into a mold flask.

It is to be understood that the form of the SAND LEVEL SENSING AND DISTRIBUTION APPARATUS described is a preferred embodiment thereof and that various changes and modifications may be made therein without departing from the spirit of the invention or scope as defined in the following claims.

What is claimed is:

1. A method for dispersing sand from a batch hopper to a flask comprising the steps of:

a. positioning a sensor assembly at substantially the uppermost edge of the sand within the batch hopper;

b. lowering said sensor assembly a predetermined distance according to parameters maintained in a control unit;

c. generating a signal using said sensor assembly indicating when said sensor assembly detects sand within at the level of the sensor assembly within the batch hopper;

d. opening a sand gate to disperse sand from the batch hopper according to said signal from said sensor assembly;

e. monitoring the dispersion of sand from the batch hopper using said sensor assembly; and f. stopping the dispersion of sand from said batch hopper when the top level of sand reaches a level substantially equivalent to said sensor assembly.

2. The method as described in claim 1 further comprising the step of repeating steps of step b through step f until sand completely surrounds a mold positioned in the flask.

3. The method as described in claim 1 wherein step a further includes the steps of:

moving said sensor assembly upward to home position substantially near the top of the batch hopper;

commencing a slow downward movement of said sensor assembly using an attached motor; and continuously providing a signal from said sensor assembly corresponding to the lack of sand at the same level of said sensor assembly.

4. A method for dispersing sand from a batch hopper into a flask to surround a mold in the flask with the sand, the method comprising the steps of:

a. positioning a sensor assembly proximate the batch hopper;

b. monitoring an uppermost edge of the sand within the batch hopper with said sensor assembly;

c. determining a desired level of distribution of the sand from the batch hopper into the flask;

d. dispersing sand through a sand gate assembly mounted subjacent the batch hopper;

e. monitoring the dispersion of sand from the batch hopper using said sensor assembly; and f. sending a signal from said sensor assembly to stop said dispersion of sand from the batch hopper when the uppermost edge of the sand in the batch hopper reaches said desired level of distribution.

5. The method for dispersing sand as described in claim 4, further comprising the step of repeating the steps of step b through step f until sand completely surrounds the mold positioned in the flask.

6. The method for dispensing sand as described in claim 4 wherein step c further comprises the step of lowering said sensor assembly to said desired level of distribution.

7. The method for dispensing sand as described in claim 6, wherein after step c, further comprising the step of commencing a downward movement of said sensor assembly using an attached motor, said downward movement corresponding to said desired level of distribution of the sand.

8. The method for dispensing sand as described in claim 4 wherein step b further comprises the steps of:

moving said sensor assembly to a position substantially near the uppermost edge of sand within the batch hopper.

9. The method for dispensing sand as described in claim 4 wherein step e further comprises continuously providing a signal from said sensor assembly corresponding to the presence of sand in the batch hopper.

* * * * *